US007416271B2

(12) United States Patent
Umeda

(10) Patent No.: US 7,416,271 B2
(45) Date of Patent: Aug. 26, 2008

(54) INK-JET RECORDING APPARATUS WITH WIPER BLADE

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 355 days.

(21) Appl. No.: 11/212,096

(22) Filed: Aug. 26, 2005

(65) Prior Publication Data

US 2006/0044344 A1 Mar. 2, 2006

(30) Foreign Application Priority Data

Aug. 27, 2004 (JP) ..... 2004-248492

(51) Int. Cl.
*B41J 2/165* (2006.01)

(52) U.S. Cl. ..... 347/33; 347/22

(58) Field of Classification Search ..... 347/33, 347/22

See application file for complete search history.

(56) References Cited

U.S. PATENT DOCUMENTS 6,109,725 A * 8/2000 Saikawa et al. ..... 347/33
6,672,704 B2 * 1/2004 Katakura et al. ..... 347/23
2003/0122892 A1 * 7/2003 Lim ..... 347/33

FOREIGN PATENT DOCUMENTS

JP 9-76517 3/1997
JP 2000-141671 5/2000

* cited by examiner

*Primary Examiner*—Manish S. Shah
*Assistant Examiner*—Mark J Stevenosky, Jr.
(74) *Attorney, Agent, or Firm*—Banner & Witcoff, Ltd

(57) ABSTRACT

An ink-jet recording apparatus including: a recording head which has a nozzle surface in which nozzles are open and which ejects ink toward a recording medium; and a wiper blade which wipes the nozzle surface to remove substances adhering thereto, by a relative movement of the wiper blade and the recording head, wherein the ink-jet recording apparatus is arranged such that the wiper blade wipes the nozzle surface while being in contact with the nozzle surface by a magnetic attraction force acting between the wiper blade and the nozzle surface.

20 Claims, 9 Drawing Sheets

INK-JET RECORDING APPARATUS WITH WIPER BLADE

The present application is based on Japanese Patent Application No. 2004-248492 filed on Aug. 27, 2004, the contents of which are incorporated herein by reference.

BACKGROUND OF THE INVENTION

1. Field of the Invention

The present invention relates in general to an ink-jet recording apparatus (ink-jet printer) equipped with a cleaning mechanism for removing substances such as ink and paper dust adhering to or deposited on its nozzle surface.

2. Discussion of Related Art

In a cleaning mechanism of an ordinary ink-jet recording apparatus, a wiper blade formed of an elastic material such as a rubber is provided. In operation, the wiper blade and a nozzle surface in which nozzles are open are moved relative to each other with the wiper blade being pressed onto the nozzle surface to such an extent that a leading end portion of the wiper blade contacting the nozzle surface is deflected or flexed, thereby wiping the nozzle surface for removing ink and the like adhering thereto.

In the cleaning mechanism of this type, when the deflected wiper blade is restored to its original shape after the wiper blade has wiped the nozzle surface, the ink and the like may be undesirably scattered thereabout.

To deal with the problem indicated above, various techniques are disclosed. For instance, JP-A-9-76517 discloses an ink-jet recording apparatus in which a wiper blade is arranged to have JIS A hardness of 40-60 degrees specified by JIS K 6301 for the purpose of controlling a speed at which the wiper blade is restored to its original shape, whereby the scattering of the ink is prevented. As another technique, JP-A-2000-141671 discloses an ink-jet recording apparatus in which a wiper blade has a tapered configuration at its leading end portion that is to contact the nozzle surface, whereby the scattering of the ink is prevented.

SUMMARY OF THE INVENTION

The inventor of the present invention made a study on the disclosed ink-jet apparatuses and recognized that the scattering of the ink could not be sufficiently prevented. It is therefore an object of the invention to provide an ink-jet recording apparatus capable of preventing, with higher reliability, the scattering of the ink and the like adhering to a wiper blade after wiping of the nozzle surface by the wiping blade.

For wiping the ink deposited on or adhering to the nozzle surface away from the nozzle surface with high reliability, it is needed that a contact pressure between the wiper blade and the nozzle surface is set to a sufficiently high level required for wiping the ink away from the nozzle surface. Conventionally, the required contact pressure is ensured by pressing the wiper blade onto the nozzle surface to such an extent that the leading end portion of the wiper blade is deflected or flexed.

In the conventional arrangement, therefore, since the largely deflected wiper blade is restored to its original shape after the wiper blade has wiped the nozzle surface, the ink which has been wiped off by the wiping blade and adhered thereto is scattered thereabout.

Namely, since the contact pressure between the nozzle surface and the wiper blade required for wiping the nozzle surface is conventionally ensured by deflecting the wiper blade, the restoring deformation of the wiper blade to its original shape after it has wiped the nozzle surface is inevitable. Thus, it is difficult in such an arrangement to prevent the scattering of the ink.

The present invention has been developed in the light of the situations described above. The object indicated above may be achieved according to a principle of the invention, which provides an ink-jet recording apparatus comprising: a recording head which has a nozzle surface in which nozzles are open and which ejects ink toward a recording medium; and a wiper blade which wipes the nozzle surface to remove substances adhering thereto, by a relative movement of the wiper blade and the recording head. The ink-jet recording apparatus is arranged such that the wiper blade wipes the nozzle surface while being in contact with the nozzle surface by a magnetic attraction force acting between the wiper blade and the nozzle surface.

In the ink-jet recording apparatus constructed as described above, it is possible to set a contact pressure between the wiper blade and the nozzle surface to a sufficiently high level required for wiping the ink away from the nozzle surface with high reliability by a magnetic attraction force, without largely deflecting the wiper blade. Therefore, this arrangement is free from the conventionally experienced phenomenon that the largely deflected wiper blade is restored to its original shape after the wiping of the nozzle surface by the wiper blade, so that the scattering of the ink adhering to the wiper blade after wiping can be prevented with high reliability.

In the conventional arrangement wherein the predetermined contact pressure is ensured by contact of the wiper blade and the nozzle surface with the wiper blade being deflected, it is needed to maintain positional accuracy of the wiper blade with respect to the recording head at a high level. Accordingly, in the conventional arrangement, it is required to strictly control variation in dimensions of the components such as the wiper blade and the recording head and error in assembling the components.

In contrast, in the present arrangement wherein the wiper blade and the nozzle surface contact each other owing to the magnetic attraction force acting therebetween such that the wiper blade and the nozzle surface are attracted to each other, the variation in the dimensions of the components and the error in assembling the components can be easily absorbed.

Since there is no need of strictly controlling the dimensional variation of the components and the assembling error, the ink and the like deposited on or adhering to the nozzle surface can be reliably removed therefrom by setting the contact pressure between the wiper blade and the nozzle surface to a sufficiently high level required for wiping the nozzle surface while reducing a manufacturing cost of the ink-jet recording apparatus.

BRIEF DESCRIPTION OF THE DRAWINGS

The above and other objects, features, advantages and technical and industrial significance of the present invention will be better understood by reading a following detailed description of preferred embodiments of the invention, when considered in connection with the accompanying drawings, in which.

DETAILED DESCRIPTION OF THE PREFERRED EMBODIMENTS

Figure 1:
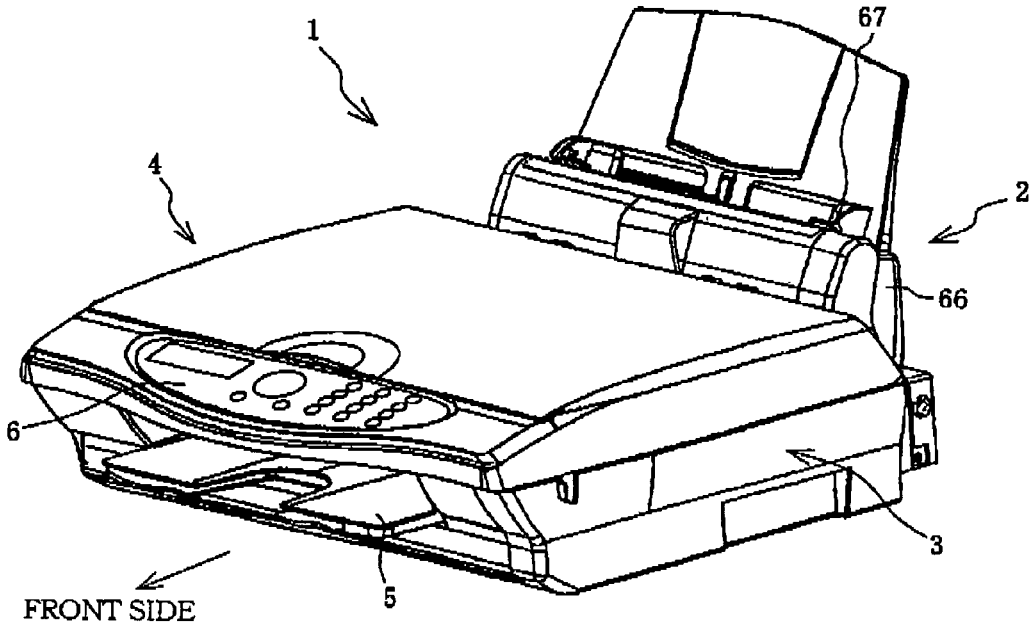
FIG. 1 is a perspective view showing a multi-function apparatus to which the principle of the invention is applied.

Referring to the drawings, there will be described preferred embodiments of the present invention.

First Embodiment

FIG. 1 shows a multi-function apparatus 1 to which the principle of the invention is applied. The multi-function apparatus 1 has functions as a printer, a copier, a scanner, a facsimile machine, and a telephone. Accordingly, the multi-function apparatus 1 serves as an ink-jet recording apparatus.

As shown in FIG. 1, the multi-function apparatus 1 is provided with a sheet-supply device 2 at its rear end, an ink-jet printer 3 on a lower front side of the sheet-supply device 2, and a reading device 4 which has functions as the copier and the facsimile machine and which is located above the printer 3. A sheet-discharge tray 5 is provided on a front side of the printer 3, and an operating panel 6 is provided at a front end portion of an upper surface of the reading device 4.

The sheet-supply device 2 includes an inclined-wall portion 66 for holding sheets of paper each as a recording medium in an inclined posture, and an extensible sheet guide 67 removably mounted on the inclined-wall portion 66, whereby a plurality of paper sheets can be stacked on the sheet-supply device 2. A sheet-supply motor (not shown), a sheet-supply roller (not shown) and the like are built in the inclined-wall portion 66. The sheet-supply roller is rotated by a drive force of the sheet-supply motor, whereby the rotating sheet-supply roller feeds a sheet into the printer 3. The extensible sheet guide 67 is configured to extend equally to its widthwise opposite sides while appropriately maintaining the center position of the plurality of sheets stacked on the inclined-wall portion 66, thereby preventing the sheets from sliding sideways.

Figure 2:
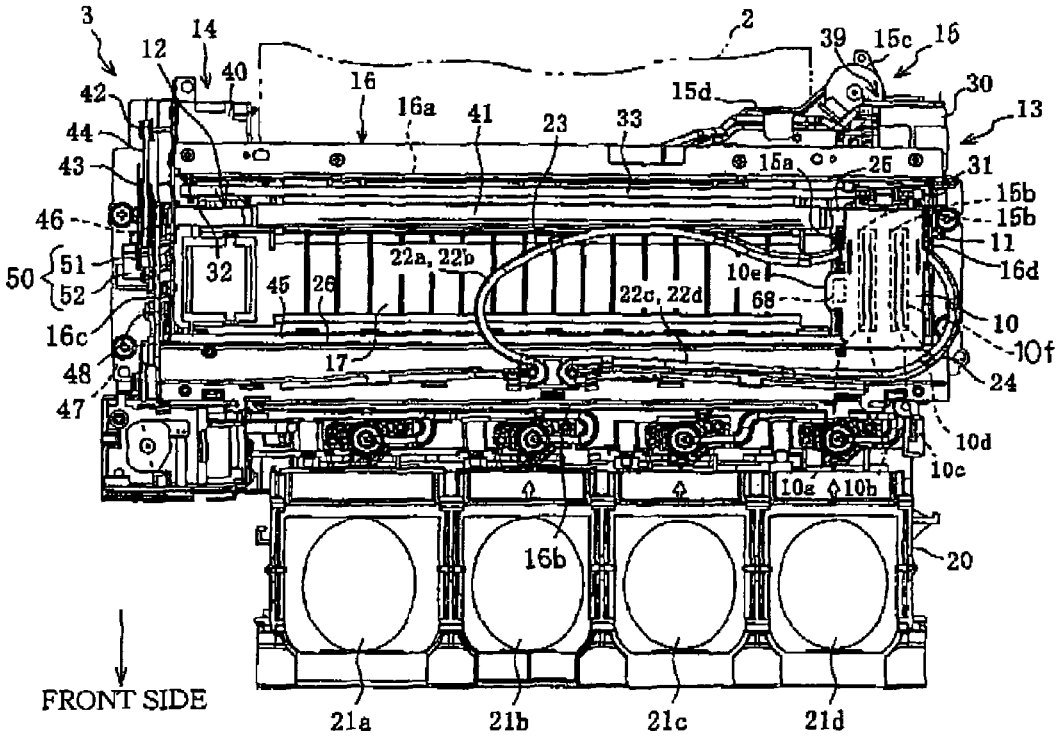
FIG. 2 is a plan view showing a printer of the multi-function apparatus of FIG. 1.

There will be next explained the printer 3 referring to FIG. 2 showing an internal structure thereof. The printer 3 includes: a recording head 10; a carriage 11 carrying the recording head 10; a guide mechanism 12 which movably supports the carriage 11 and guides the same 11 in a moving direction of the carriage 11 (i.e., in a transverse direction as viewed in FIG. 2); a carriage-move mechanism 3 which moves the carriage 11 in the moving direction; a sheet-feed mechanism 14 which feeds a sheet supplied by the sheet-supply device 2; and a maintenance mechanism 15 for the recording head 10.

The printing device 3 has a frame 16 of a generally rectangular parallelepiped which has a large length (i.e., a large dimension in the transverse direction as viewed in FIG. 2) and a small height. On the frame 16, there are mounted the guide mechanism 12, the carriage-move mechanism 13, the sheet-feed mechanism 14, the maintenance mechanism 15, etc. Inside the frame 16, the recording head 10 and the carriage 10 are accommodated movably in the longitudinal direction of the frame 16 (i.e., in the transverse direction as viewed in FIG. 2).

A sheet inlet (not shown) and a sheet outlet (not shown) are respectively formed in a rear wall 16*a* and a front wall 16*b* of the frame 16. The sheet supplied by the sheet-supply device 2 is introduced into the frame 16 through the sheet inlet, fed forward by the sheet-feed mechanism 14, and discharged out of the sheet outlet.

A platen 17 with a plurality of ribs is mounted on the bottom of the frame 16. Recording or printing is performed by the recording head 10 on the sheet moving on the platen 17 in the frame 16, thereby forming an image, etc., on the sheet.

Four ink cartridges 21*a*-21*d* accommodating mutually different four colors of inks and mounted on a cartridge-mounting portion 20 that is located on a front side of the frame 16 are connected to the recording head 10 via respective four flexible ink tubes 22*a*-22*d* passing through the inside of the frame 16. Thus, the four different colors of inks are supplied from the respective ink cartridges 21*a*-21*d* to the recording head 10 via the respective ink tubes 22*a*-22*d*.

Two flexible printed circuits 23, 24 (hereinafter referred to as "the FPC 23, 24") are provided inside the frame 16. One 23 of the FPCs 23, 24 located on a left side as viewed in FIG. 2 extends integrally with two 22*a*, 22*b* of the four ink tubes 22*a*-22*d* and is connected to the recording head 10 while the other 24 of the FPCs 23, 24 located on a right side as viewed in FIG. 2 extends integrally with two 22*c*, 22*d* of the four ink tubes 22*a*-22*d* and is connected to the recording head 10. A plurality of signal lines are wired on the FPCs 23, 24 for electrically connecting an electronic control device (not shown) and the recording head 10 to each other.

The guide mechanism 12 includes a guide shaft 25 and a guide rail 26. The guide shaft 25 is disposed inside the frame 16 at its rear portion so as to extend in the transverse direction as seen in FIG. 2 and connected at its left-side end to a left wall 16*c* of the frame 16 and at its right-side end to a right wall 16*d* of the same 16. The guide rail 26 is disposed inside the frame 16 at its front portion so as to extend in the transverse direction of FIG. 2. A rear end portion of the carriage 11 is slidably mounted on the guide shaft 25 while a front end portion of the same 11 slidably engages the guide rail 26.

The carriage-move mechanism 13 includes: a carriage motor 30 attached to a backside of a right end portion of the rear wall 16*c* of the frame 16 so as to face forward; a drive pulley 81 rotatably driven by the carriage motor 30; a driven pulley 32 rotatably supported on a left end portion of the rear wall 16*a*; and a belt 33 looped over the pulleys 31, 32 and fixed to the carriage 11. Further, a first encoder 39 is provided in the vicinity of the carriage motor 30 for detecting an amount of movement of the carriage 11 (the recording head 10).

The sheet-feed mechanism 14 includes: a sheet-feed motor 40 attached to a backwardly-extending portion of the left wall 16*c* of the frame 16 which extends backwards of the rear wall 16*a*: a register roller 41 which is disposed inside the frame 16 below the guide shaft 25 such that its axis extends in the transverse direction and which is rotatably supported at its left and right ends by the left wall 16*c* and the right wall 16*d* of the frame 16, respectively; a drive pulley 42 rotatably driven by the sheet-feed motor 40; a driven pulley 43 connected to the left end of the register roller 41; and a belt 44 looped over the pulleys 42, 43.

When the sheet-feed motor 40 is driven, the register roller 41 rotates, thereby enabling the sheet to be fed in a frontwardand-backward direction. In FIG. 2, though the 41 is illustrated in an exaggerated manner, the resister roller 41 is actually disposed below the guide shaft 25.

The sheet-feed mechanism 14 includes: a sheet-discharge roller 45 which is disposed inside the frame 16 on its front side such that its axis extends in the longitudinal direction of the frame 16 and which is rotatably supported at its left and right ends by the left wall 16*c* and the right wall 16*d* of he frame 16, respectively; a driven pulley 46 formed integrally with the driven pulley 43; a driven pulley 47 connected to the left end of the sheet-discharge roller 45; and a belt 48 looped over the pulleys 46, 47. When the sheet-feed motor 40 is driven, the sheet-discharge roller 45 rotates, thereby enabling the sheet to be fed forward for discharging it to the discharge tray 5.

An encoder disc 51 is fixed to the driven pulley 43. A photo-interrupter 52 is attached to the left wall 16*c* of the frame 16 so as to sandwich the encoder disc 51 by and between a light-emitting portion and a light-receiving portion thereof. The sheet-feed motor 40 is driven and controlled by the electronic control device on the basis of a detect signal from the photo-interrupter 52 (second encoder 50).

At a left end of the recording head 10, there is provided a media sensor 68 which is capable of detecting a leading end, a trailing end, and side edges of the sheet. The media sensor 68 is an optical sensor including a light-emitting portion (light-emitting device) and a light-receiving portion (light-receiving device) and is mounted on a sensor mounting portion 10*e* of the recording head 10 which protrudes leftward therefrom, such that the media sensor 68 faces downward.

A resist sensor (not shown) for detecting absence or presence of the sheet, and the leading end the trailing end of the sheet is disposed upstream of the media sensor 68 as seen in the sheet-feeding direction (i.e., behind the media sensor 68). More specifically, the resist sensor is attached to a front end of an upper cover which forms a sheet-feed path of the sheet-supply device 2.

The resist sensor may be constituted, for instance, by a mechanical sensor including a detector which protrudes toward the sheet-feed path and which is pivoted by the sheet that is being fed; a photo-interrupter equipped with a light-emitting portion and a light-receiving portion and detecting the pivoting movement of the detector; and a torsion spring which biases the detector toward the sheet-feed path.

The detector has an integrally formed interrupting portion. When the detector is pivoted by the sheet that is being fed, the interrupting portion of the detector moves away from space between the light-emitting portion and the light-receiving portion of the photo-interrupter, so that transmission of the light from the light-emitting portion to the light-receiving portion is not interrupted, thereby turning on the resist sensor. On the contrary, when the sheet is not being fed and the detector is biased by the torsion spring toward the sheet-feed path, the interrupting portion of the detector is located between the light-emitting portion and the light-receiving portion, so that the transmission of the light from the light-emitting portion to the light-receiving portion is interrupted, thereby turning off the resist sensor.

The maintenance mechanism 15 includes: a wiper blade 15*a* which wipes a nozzle surface 10*f* (a lower surface) of the recording head 10 in which nozzles are open; two caps 15*b*, 15*b* each of which is capable of fluid-tightly covering the nozzle surface 10*f* so as to surround appropriate two ink nozzle groups among four ink nozzle groups 10*a*-10*d*; and a drive motor 15*c* which drives the caps 15*b* for attaching and detaching the caps 15*b* to and from the nozzle surface 10*f*. The wiper blade 15*a*, the caps 15*b*, and the drive motor 15*c*, etc., are fixed, via a mounting board 15*d*, to a right portion of the lower surface of the bottom wall of the frame 16.

The recording head 10 has the four groups 10*a*-10*d* of the ink nozzles which are open downwards, in other words, the nozzle surface of the recording head 10 faces downwards in a vertical direction (i.e., faces in a gravity direction). The four different colors of inks, i.e., black, cyan, yellow, and magenta, are ejected from the nozzles of the respective four ink nozzle groups 10*a*-10*d* toward the sheet as the recording medium, whereby an image and the like is recorded on the sheet.

Because the caps 15*b* and the four ink nozzle groups 10*a*-10*d* are provided on the underside of the recording head 10 and cannot be seen from the top, they are indicated by a dot line in FIG. 2. Each of the four ink nozzle groups 10*a*-10*d* is constituted by the ink nozzles (not shown) arranged in the sheet feeding direction. The ink nozzles belonging to the same group eject the same color of ink. The four ink nozzle groups 10*a*-10*d* are arranged in order in the moving direction of the carriage 11. The number of the ink nozzles in each group is 150, for instance.

Figure 3A:
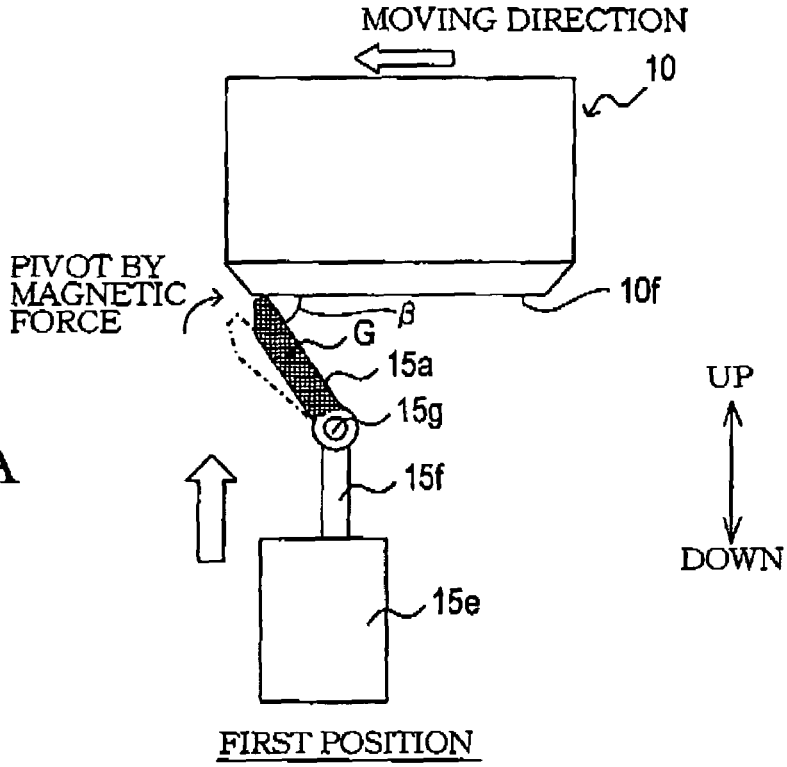
FIGS. 3A and 3B are views showing an outline of a cleaning mechanism according to a first embodiment of the invention.
Figure 3B:
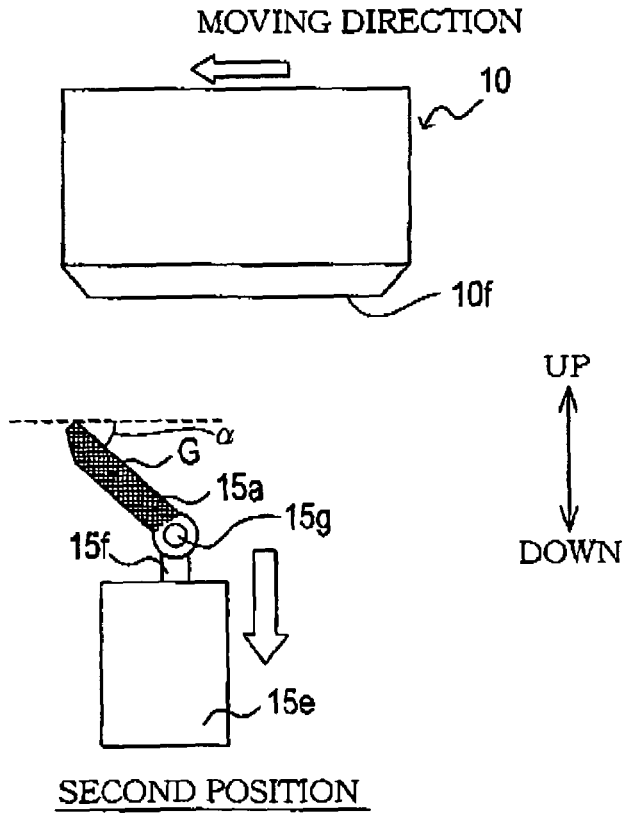

Referring next to FIGS. 3A and 3B, there will be explained cleaning of the nozzle surface 10*f* according to the principle of the invention. FIGS. 3A and 3B are schematic views showing an outline of a cleaning mechanism for cleaning the nozzle surface 10*f*.

The wiper blade 15*a* is arranged to wipe the nozzle surface 10*f* to remove substances such as the ink adhering to the nozzle surface 10*f*, by a relative movement of the wiper blade 15*a* and the recording head 10 in a direction parallel to the nozzle surface 10*f*. In the present embodiment, the recording head 10 moves relative to the wiper blade 15*a*, whereby the wiper blade 15*a* and the nozzle surface 10*f* are moved relative to each other.

At least a portion of the recording head 10 that constitutes the nozzle surface 10*f* is formed of a metal which is made of a ferrous ferromagnetic material such as an FE42 alloy. The wiper blade 15*a* is constituted by a flexible magnet (e.g., a magnetic rubber) obtained by diffusing powders having a magnetic property such as a rare earth magnet, in an elastic body such as a urethane rubber, as a matrix or a base material.

In FIGS. 3A and 3B, the reference numeral 15*e* denotes a linear solenoid as a position changer which changes a position of the wiper blade 15*a* relative to the nozzle surface 10*f* (the recording head 10). The wiper blade 15*a* is displaced by the linear solenoid 15*e* in a direction perpendicular to the moving direction of the recording head 10 (i.e., in a direction intersecting a direction of the relative movement of the wiper blade 15*a* and the recording head 10) and in a direction parallel to the gravity direction (i.e., in a direction in which the gravity acts, or in a vertical direction).

More specifically described, the linear solenoid 15*e* changes the position of the wiper blade 15*a* between: a first position shown in FIG. 3A which enables the wiper blade 15*a* to be attached to the nozzle surface 10*f* by a magnetic attraction force; and a second position shown in FIG. 3B which is more distant from the nozzle surface 10*f* than the first position. The operation of the linear solenoid 15*e* is controlled by the electronic control device.

It is noted that the linear solenoid 15*e* is an actuator constituted by an exciting coil, a spring, a moving core, etc. The linear solenoid 15*e* is arranged such that the moving core is moved by utilizing a difference in magnitude between an electromagnetic force induced by the exciting coil and an elastic force of the spring.

In the present embodiment, when the linear solenoid 15*e* is energized, the electromagnetic force surpasses the elastic force of the spring, so that the moving core moves upward as seen in FIG. 3, thereby placing the wiper blade 15*a* at the first position. When the linear solenoid 15*e* is de-energized, on the other hand, the moving core moves downward as seen in FIG. 3 by the elastic force of the spring, thereby placing the wiper blade 15*a* at the second position.

The wiper blade 15*a* is disposed below the nozzle surface 10*f* in the vertical direction and is pivotably connected, at a lower end thereof remote from the nozzle surface 10*f*, to a leading end of a rod portion 15*f* of the linear solenoid 15*e* that is disposed below the nozzle surface 10*f*, which rod portion is connected to the moving core and moves together with the moving core.

A connection between the lower end of the wiper blade 15*a* and the leading end of the rod portion 15*f* of the linear solenoid, i.e., an axis 15*g* of a pivotable movement of the wiper blade 15*a* is located at the lower end side of the wiper blade 15*a*. Thus, the wiper blade 15*a* is pivotable about its lower end. (The axis 15*g* of the pivotable movement may be hereinafter referred to as "the pivoting axis 15*g*".) More specifically explained, the pivoting axis 15*g* of the wiper blade 15*a* is located at a position which is below a center G of gravity of the same 15*a* and which deviates in a horizontal direction (deviates on the left side as seen in FIG. 3A) with respect to the center of the nozzle surface 10*f* in a state in which the wiper blade 15*a* is in contact with the nozzle surface 10*f* at the first position indicated above.

In the present embodiment, when the wiper blade 15*a* is placed at the second position at which the wiper blade 15*a* is not attached to the nozzle surface 10*f* the wiper blade 15*a* defines an angle α from about 20° to about 30° with respect to a horizontal plane and is inclined such that the lower end thereof remote from the nozzle surface 10*f* is located below another end thereof near to the nozzle surface 10*f*. When the wiper blade 15*a* is placed at the first position at which the wiper blade 15*a* is attached to the nozzle surface 10*f* on the other hand, the wiper blade 15*a* defines an angle β from about 45° to about 60° with respect to the horizontal plane. The wiper blade 15*a* wipes the nozzle surface 10*f* such that the substances adhering to the same 10*f* are removed by the wiper blade 15*a* at its surface that forms an acute angle with respect to the nozzle surface 10*f*.

It is noted that a wiping, device is constituted by including the wiper blade 15*a* and the linear solenoid 15*e* as the position changer.

Next, there will be explained operation of the cleaning mechanism (the cleaning operation). The wiping action by the wiper blade 15*a* for wiping the nozzle surface 10*f*, namely, the cleaning operation for cleaning the recording head 10 is initiated by manipulation on a cleaning switch (not shown) provided in the operating panel 6 or a command from the electronic control device. In the cleaning operation, the linear solenoid 15*e* and the recording head 10 (the nozzle surface 10*f*) operate as indicated in a time chart shown in FIG. 4.

When the cleaning switch is manually tuned on, the linear solenoid 15*e* is initially energized, so that the wiper blade 15*a* is displaced upwards so as to reach the first position. In the meantime, the recording head 10 starts to move at timing when a first predetermined time t1 has elapsed after the reaching of the wiper blade 15*a* to the first position, and is accelerated, taking a second predetermined time t2, up to a first moving speed (a wiper-blade attaching speed) V1 at which the wiper blade 15*a* is attached to the nozzle surface 10*f*. The moving speed is a speed of the relative movement of the wiper blade 15*a* and the recording head 10.

Until a third predetermined time t3 elapses after the moving speed of the recording head 10 has reached the first moving speed V1, the first moving speed V1 is maintained. After the third predetermined time t3 has elapsed, the recording head 10 is accelerated, taking a fourth predetermined time t4, up to a second moving speed (the wiping speed) V2 which is higher than the first moving speed V1 and at which the nozzle surface 10*f* is wiped by the wiper blade 15*a*.

When a fifth predetermined time t5 has elapsed after reaching the second moving speed V2, the recording head 10 stops moving taking a sixth predetermined time t6. In the meantime, the wiper blade 15*a* is kept located at the first position until a seventh predetermined time t7 elapses after the recording head 10 has stopped when the seventh predetermined time t7 has elapsed, the linear solenoid 15*e* is de-energized, so that the wiper blade 15*a* is retracted from the first position to the second position.

Hereinafter, a time duration between the energization of the linear solenoid 15*e* and the expiration of the third predetermined time t3 may be referred to as a preparation mode in which the wiper blade 15*a* spaced apart from the nozzle surface 10*f* is attached thereto, a time duration between the commencement of the fourth predetermined time t4 between the expiration of the fifth predetermined time t5 may be referred to as a wipe mode in which the wiper blade 15*a* and the nozzle surface 10*f* move relative to each other with the wiper blade 15*a* being in contact with the same 10*f*, and a time duration between the commencement of the sixth predetermined time t6 and the timing at which the wiper blade 15*a* is retracted from the first position to the second position may be referred to as a retract mode.

In the cleaning operation for cleaning the recording head 10, the wiping action by the wiper blade 15*a* for wiping the nozzle surface 10*g* is performed as follows by moving the recording head 10 as described above and operating the linear solenoid 15*e* as described above.

Figure 5A:
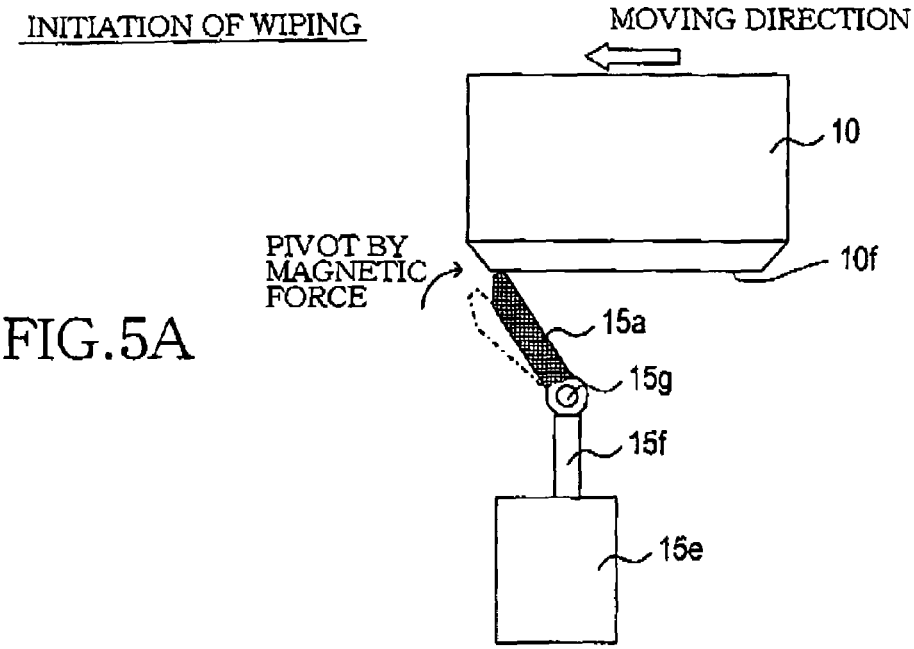
FIGS. 5A and 5B are views showing operation by the cleaning mechanism in a wipe mode according to the first embodiment.

In the preparation mode, the wiper blade 15*a* is displaced from the second position to the first position as shown in FIG. 5A, so that, in a time period from the first predetermined time t1 to the third predetermined time t3, the wiper blade 15*a* is attracted toward the nozzle surface 10*f* by the magnetic attraction force acting therebetween and is consequently brought into contact with or attached to the nozzle surface 10*f*.

Figure 5B:
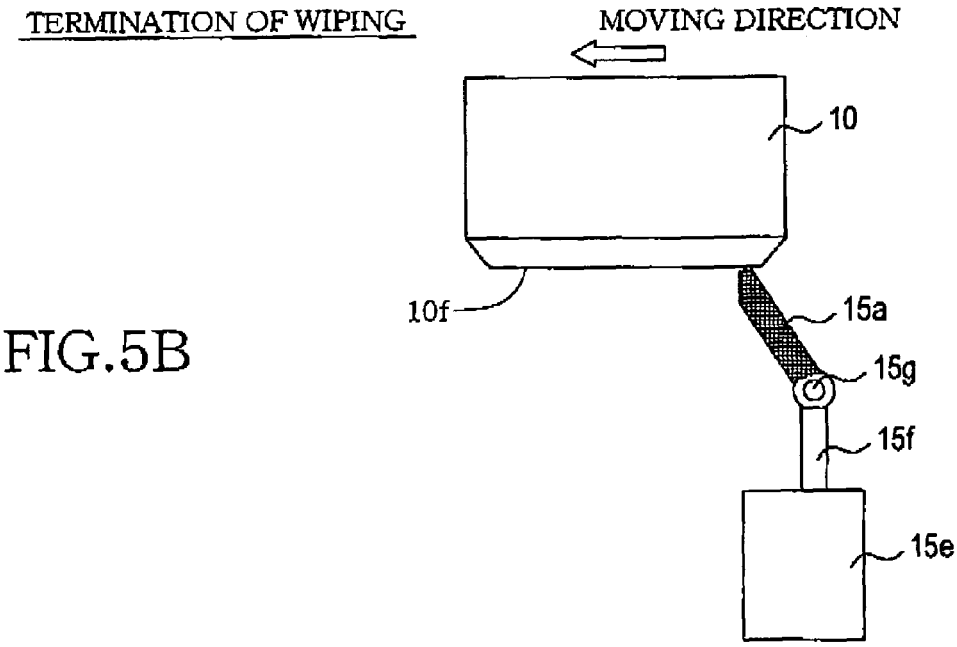

Then, the preparation mode is followed by the wipe mode. In the wipe mode, the recording head 10 moves relative to the wiper blade 15 as shown in FIG. 5B, whereby the substances adhering to the nozzle surface 10*f* are wiped off by the wiper blade 15*a*.

Next, the wipe mode is followed by the retract mode. In the retract mode, since the magnetic attraction force between the wiper blade 15*a* and the nozzle surface 10*f* is reduced, the wiper blade 15*a* contacting the nozzle surface 10*f* separates away from the nozzle surface 10*f* spontaneously by its own weight (by gravity).

In the illustrated embodiment wherein the wiper blade 15*a* is brought into contact with the nozzle surface 10*f* by the magnetic attraction force acting therebetween, the contact pressure between the wiper blade 15*a* and the nozzle surface 10*f* can be made sufficiently high required for wiping the nozzle surface 10*f* with high reliability, without deflecting the wiper blade 15*a* to a large extend as experienced in the conventional arrangement.

Therefore, the present arrangement is free from the conventionally experienced phenomenon that the largely deflected wiper blade is restored to its original shape after it has wiped the nozzle surface 10*f*, thereby preventing the ink to be scattered due to the restoration of the largely deflected wiper blade.

In the present embodiment, the magnetic attraction force is set such that the contact pressure between the wiper blade 15*a* and the nozzle surface 10*f* in a state in which the wiper blade 15*a* is attached to the nozzle surface 10*f* is not smaller than about 0.003 MPa, preferably not smaller than 0.006 MPa. Further, the flexible magnet that constitutes the wiper blade 15*a* has JIS A hardness of about 30-60 degrees specified in JIS K 6301.

In the present embodiment, the wiper blade 15*a* is configured such that its upper end portion (its leading end portion) that is to be in contact with the nozzle surface 10*f* is tapered with its cross sectional area gradually reduced, thereby reducing an amount of the ink which is to adhere to the leading end portion of the wiper blade 15*a* in wiping the nozzle surface 10*f*. Thus, the scattering of the ink can be reliably prevented.

In the conventional arrangement wherein the predetermined required contact pressure between the wiper blade and the nozzle surface is assured by bringing the wiper blade into contact with the nozzle surface with the wiper blade being deflected, it is needed to keep the positional accuracy of the wiper blade with respect to the recording head 10 at a relatively high level. Therefore, in the conventional arrangement, the variation in the dimensions of the components such as the recording head and the wiper blade and the error in assembling those components need to be strictly controlled.

In the present embodiment, in contrast, the wiper blade 15*a* and the nozzle surface 10*f* are brought into contact with each other by the magnetic attraction force acting therebetween, whereby the predetermined required contact pressure between the wiper blade 15*a* and the nozzle surface 10*f* can be assured without a need of keeping the positional accuracy of the wiper blade 15*a* with respect to the recording head 10 at a high level.

Therefore, because the dimensional variation of the components and the error in assembling the components can be easily absorbed in the present arrangement, the ink and the like adhering to the nozzle surface 10*f* can be reliably removed therefrom by setting the contact pressure between the wiper blade 15*a* and the nozzle surface 10*f* at the required sufficiently high level while reducing a manufacturing cost of the multi-function apparatus 1.

In the present embodiment wherein the portion of the recording head 10 that gives the nozzle surface 10*f* is formed of the magnetic material (the ferromagnetic material) while the wiper blade 15*a* is constituted by the flexible magnet, the recording head 10 may be one similar to that conventionally employed. Accordingly, the scattering of the ink and the like adhering to the wiper blade 15*a* can be surely avoided by simply changing the wiper blade 15*a* without a large design change.

Because the wiper blade 15*a* is flexible, the wiper blade 15*a* and the nozzle surface 10*f* are brought into good contact with each other, so that the ink and the like adhering to the nozzle surface 10*f* can be removed therefrom with higher reliability.

In the present embodiment wherein the linear solenoid 15*e* as the position changer changes the position of the wiper blade 15*a* between the first position and the second position as described above, the wiper blade 15*a* and the nozzle surface 10 can be easily brought into contact with each other only when the recording head 10 needs to be cleaned. For instance, even where the wiper blade 15*a* needs to be inevitably disposed, for the purpose of reducing the size of the multi-function apparatus 1, within a head-moving range for recording in which the recording head 10 moves for the recording operation, it is possible to surely bring the wiper blade 15*a* and the nozzle surface 10*f* into contact with each other only when the recording head 10 needs to be cleaned. Accordingly, the scattering of the ink and the like adhering to the wiper blade 15*a* can be prevented with higher reliability while downsizing the multi-function apparatus 1.

In the present embodiment, the first moving speed V1 is made smaller than the second moving speed V2 as described above, whereby the moving speed of the recording head 10 in the preparation mode is made smaller than that in the wipe mode. Therefore, this arrangement effectively assures an enough time period required for the wiper blade 15*a* to be attached to the nozzle surface 10*f*.

Accordingly, the wiper blade 15*a* can be brought into contact with the nozzle surface 10*f* with high reliability, so that the ink and the like adhering to wiper blade 15*a* can be surely prevented from being scattered while wiping the ink and the like adhering to the nozzle surface 10*f* with high reliability, without increasing the required time for cleaning the nozzle surface 10*f* than necessary.

The time period required for the wiper blade 15*a* to be attached to the nozzle surface 10*f* corresponds to a time period required for the wiper blade 15*a* spaced apart from the nozzle surface 10*f* to be attached to the same 10*f* by the magnetic attraction force. This time period is determined depending upon mass of the wiper blade 15*a*, the magnitude of the magnetic attraction force, etc. In this embodiment, the first moving speed V1 is set at about 1-5 ips (inch/second) and the second moving speed V2 is set at about 6-10 ips (inch/second).

In the present embodiment, the pivoting axis 15*g* of the wiper blade 15*a* is located below the center G of gravity of the same 15*a*, thereby enabling the gravity to act relatively effectively on the wiper blade 15*a* as a force in a direction in which the wiper blade 15*a* separates from the nozzle surface 10*f*.

Therefore, the wiper blade 15*a* contacting the nozzle surface 10*f* can spontaneously separate therefrom by its own weight, after the wiper blade 15*a* has wiped the nozzle surface 10*f*.

Further, it is not required in the present arrangement to additionally provide any return mechanism such as a spring for separating the wiper blade 15*a* away from the nozzle surface 10*f*, so that the scattering of the ink and the like can be prevented while avoiding an increase in the manufacturing cost of the multi-function apparatus 1.

Second Embodiment

Figure 6A:
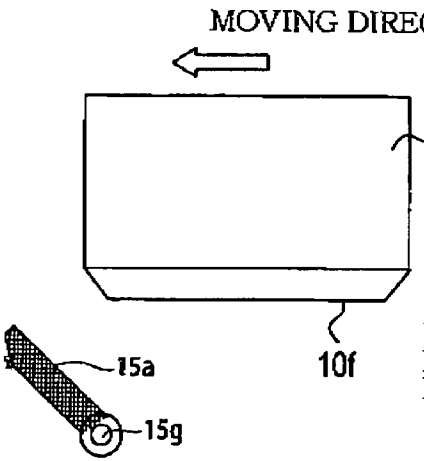
FIGS. 6A-6C are views showing operation of a cleaning mechanism according to a second embodiment of the invention.
Figure 6B:
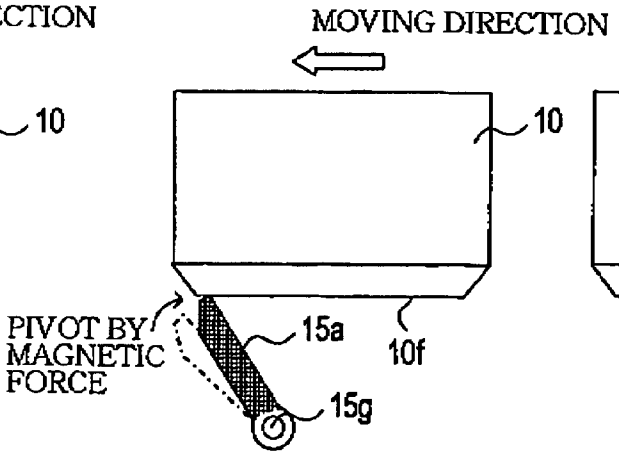
Figure 6C:
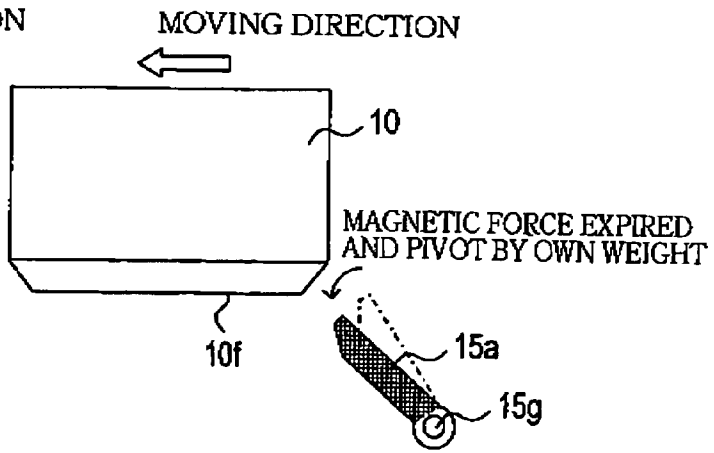

There will be next described a second embodiment of the invention referring to FIGS. 6A-6C. The illustrated first embodiment is applied to a case in which the wiper blade 15*a* wipes the nozzle surface 10*f* within the head-moving range for recording in which the recording head 10 moves for the recording operation. This second embodiment is applied to a case in which the wiper blade 15*a* wipes the nozzle surface 10*f* outside the head-moving range for recording. In this case, there is provided a head-moving range for cleaning in which the recording head 10 moves for cleaning operation to be performed thereon. Further, the wiper blade 15*a* is disposed with a position of its pivoting axis 15*g* fixed, at a position which is within the head-moving range for cleaning and which enables the wiper blade 15*a* to be attached to the nozzle surface 10*f* by the magnetic attraction force when the nozzle surface 10*f* is opposed to the wiper blade 15*a*.

In this arrangement indicated above, when the recording head 10 approaches the wiper blade 15*a*, the wiper blade 15*a* is attached to the nozzle surface 10*f* by the magnetic attraction force acting therebetween, as shown in FIGS. 6A and 6B.

The recording head 10 (the nozzle surface 10*f*) moves with the leading end portion of the wiper blade 15*a* attached to the nozzle surface 10*f*, whereby the substances adhering to the nozzle surface 10*f* are wiped off by the wiper blade 15*a*.

When the recording head 10 further moves, the magnetic attraction force between the nozzle surface 10*f* and the wiper blade 15*a* is reduced, so that the wiper blade 15*a* spontaneously separates away from the nozzle surface by its own weight, as shown in FIG. 6C.

Thus, as in the illustrated first embodiment, in this second embodiment, the required contact pressure between the wiper blade 15*a* and the nozzle surface 10*f* can be assured while easily absorbing the dimensional variation of the components and the error in assembling the components. Therefore, the scattering of the ink after the wiper blade 15*a* has wiped the nozzle surface 10*f* can be prevented with high reliability while reducing the manufacturing cost of the multi-function apparatus 1.

In this second embodiment, when the recording head 10 moves within the head-moving range for cleaning, namely, when the nozzle surface 10*f* is cleaned, the recording head 10 moves at a constant speed which enables the wiper blade 15*a* to be reliably attached to the nozzle surface 10*f*. The recording head 10 may move otherwise. As in the illustrated first embodiment, when the nozzle surface 10*f* is located at a position facing the wiper blade 15*a*, i.e., in the wipe mode, the recording head 10 may move at the second moving speed V2. When the nozzle surface 10*f* is located at a position not facing the wiper blade 15*a*, i.e., in the preparation mode, the recording head 10 may move at the first moving speed V1.

Third Embodiment

Next, there will be described a third embodiment referring to FIGS. 7A-7C. In the illustrated first and second embodiments, the wiper blade 15*a* is arranged to be pivotable about the pivoting axis 15g. In this third embodiment, the wiper blade 15*a* having flexibility is fixed at its lower end, as shown in FIGS. 7A-7C.

Figure 7A:
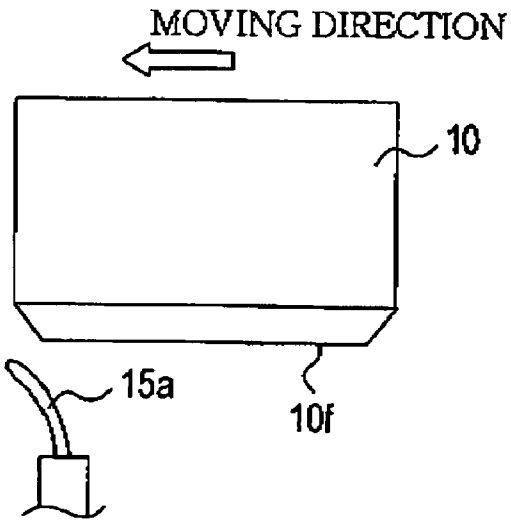
FIGS. 7A-7C are views showing operation of a cleaning mechanism according to a third embodiment of the invention.
Figure 7B:
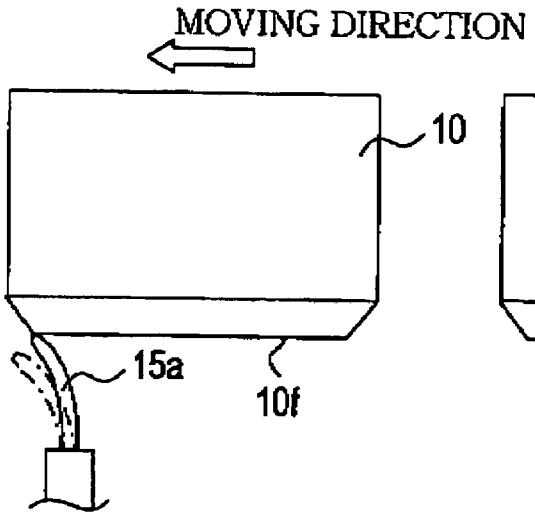
Figure 7C:
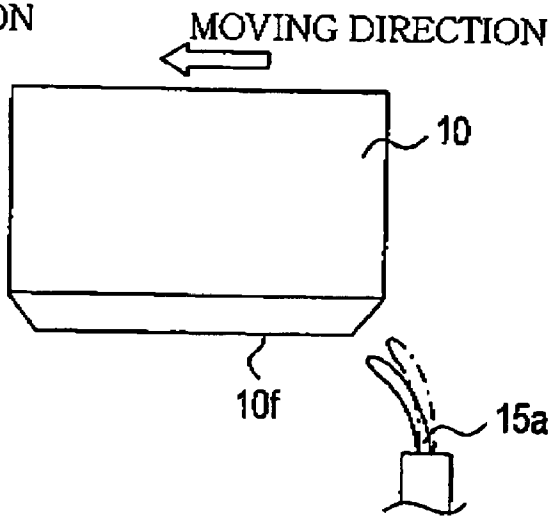

In this third embodiment, when the recording head 10 approaches the wiper blade 15*a*, the magnetic attraction force between the nozzle surface 10*f* and the wiper blade 15*a* increases, so that the curved wiper blade 15*a* elastically deforms so as to extend straight and is attached at its leading end to the nozzle surface 10*f*, as shown in FIGS. 7A and 7B.

The recording head 10 (the nozzle surface 1 of) moves with the leading end of the wiper blade 15*a* attached to the nozzle surface 10*f*, whereby the substances adhering to the nozzle surface 10*f* are wiped off by the wiper blade 15*a*.

When the recording head 10 further moves, the magnetic attraction force between the nozzle surface 10*f* and the wiper blade 15*a* is reduced and the restoring force (the elastic force) of the wiper blade 15*a* surpasses the magnetic attraction force, so that the wiper blade 15*a* slowly and gradually separates away from the nozzle surface 10*f*.

In this embodiment, after the wiping of the nozzle surface 10*f* by the wiper blade 15*a*, the wiper blade 15*a* separates away from the nozzle surface 10*f* because the restoring force surpasses the magnetic attraction force. Since the magnetic attraction force acts in a direction opposite to the restoring force, the wiper blade 15*a* which has elastically deformed in the straightly extended shape slowly and gradually curves downward to return to its original shape. Therefore, the ink and so on adhering to the wiper blade 15*a* can be prevented, with high reliability, from being scattered.

As in the illustrated second embodiment, the linear solenoid 15*e* is not employed in this third embodiment. However, the wiper blade 15*a* may be arranged to be displaced in the vertical direction using the linear solenoid 15*e* as in the illustrated first embodiment.

Fourth Embodiment

In the illustrated first and second embodiments, the entirety of the wiper blade 15*a* is constituted by the flexible magnet. The wiper blade 15*a* may be otherwise constituted.

Figure 8:
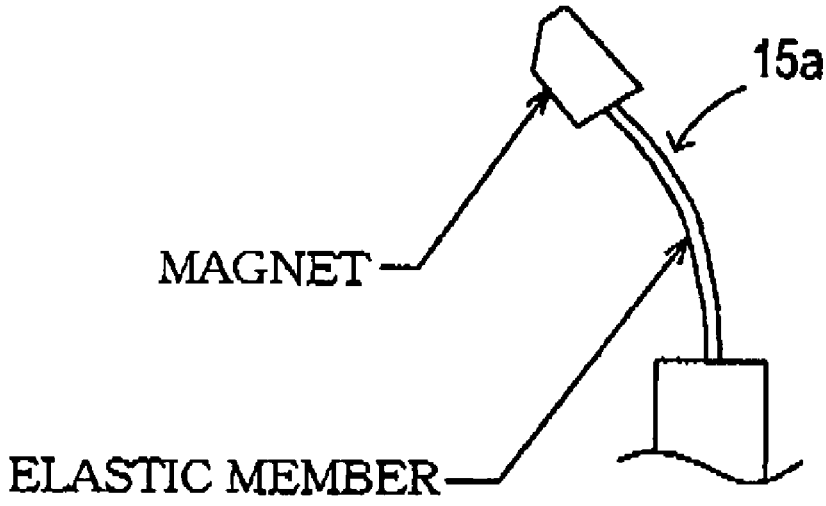
FIG. 8 is a view showing a wiper blade according to a fourth embodiment of the invention.

FIG. 8 shows a wiper blade 15*a* constructed according to a fourth embodiment. In the wiper blade 15*a* according to this fourth embodiment, a portion thereof that is to contact the nozzle surface 10*f* is constituted by a magnet without flexibility and the rest is constituted by an elastic member such as a rubber without the magnetic property or a metallic spring.

Fifth Embodiment

Figure 9:
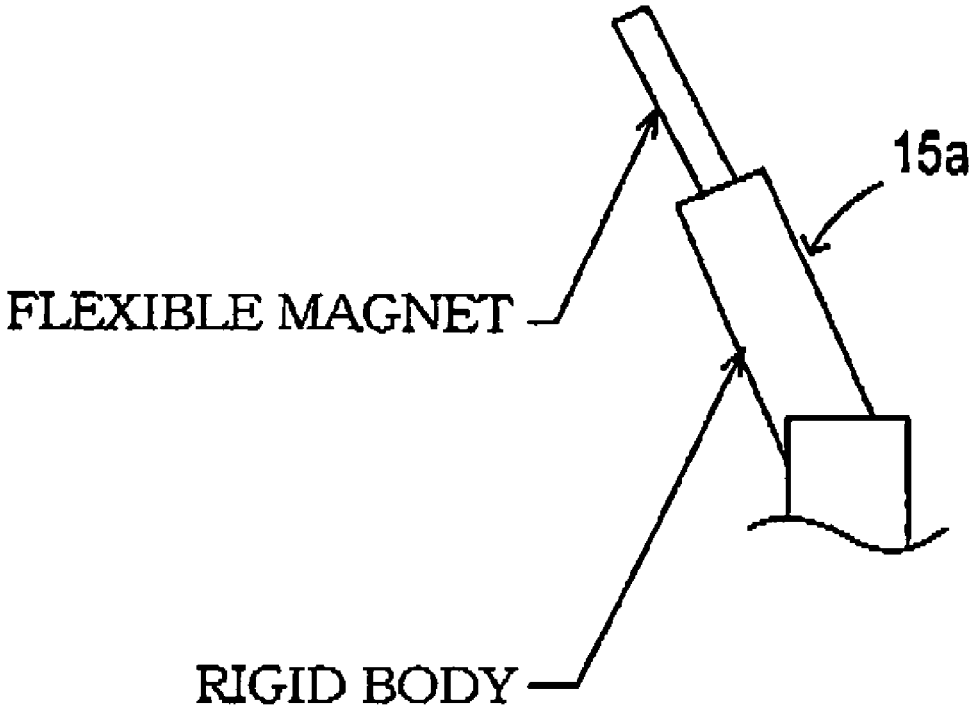
FIG. 9 is a view showing a wiper blade according to a fifth embodiment of the invention.

FIG. 9 shows a wiper blade 15*a* constructed according to a fifth embodiment as a modified example of the wiper blade 15*a* according to the fourth embodiment. In the wiper blade 15*a* according to this fifth embodiment, only a portion thereof that is to contact the nozzle surface 10*f* is constituted by the flexible magnet, and the rest is constituted by a rigid body without the magnetic property (such as a resin or a metal).

Other Embodiments

In the illustrated embodiments, the portion of the recording head 10 that provides the nozzle surface 10*f* is formed of the magnetic material while the wiper blade 15*a* is formed by including the substance which induces the magnetic field (such as the permanent magnet). The invention may be otherwise embodied. For instance, the nozzle surface 10*f* may be formed of the magnetic-field inducing substance such as the permanent magnet and the wiper blade 15*a* may be formed by including the magnetic material.

In the illustrated embodiments, the permanent magnet such as the rare earth magnet is employed as the magnetic-field inducing substance. The invention may be otherwise embodied. For instance, the wiper blade 15*a* may be formed of a rubber in which powders of the magnetic material are diffused and the nozzle surface 10*f* may be formed of the magnetic material. In this arrangement, an electromagnet may be disposed adjacent to at least one of the wiper blade 15*a* and the nozzle surface lot; thereby permitting an electromagnetic attraction force to act between the wiper blade 15*a* and the nozzle surface 10*f*.

Where the electromagnet is employed as described above, the electromagnet may be controlled to be energized and de-energized for controlling the wiper blade 15*a* to be attached to the nozzle surface 10*f* and to be separated from the same 10*f*, while the wiper blade 15*a* is kept at the first position without vertically displacing the same 15*a* by the linear solenoid 15*e*.

Further, where the wiper blade 15*a* is formed of the rubber in which the powders of the magnetic material are diffused and the nozzle surface 10*f* is formed of the magnetic material, a permanent magnet may be disposed adjacent to at least one of the wiper blade 15*a* and the nozzle surface 10*f*, thereby permitting an electromagnetic force to act between the wiper blade 15*a* and the nozzle surface 10*f*. In this case, only the permanent magnet may be displaced in the vertical direction or the permanent magnet and the wiper blade 15*a* may be simultaneously displaced in the vertical direction, with respect to the nozzle surface 10*f* for controlling the wiper blade 15*a* to be attached to the nozzle surface 10*f* and to be separated away from the same 10*f*.

In the illustrated embodiments, the wiper blade 15*a* is configured such that the leading end portion thereof is tapered with its cross sectional area gradually decreased. The wiper blade 15*a* may be otherwise configured. For instance, the wiper blade 15*a* may be configured to have a cross sectional area that is constant throughout its length.

Figure 4:
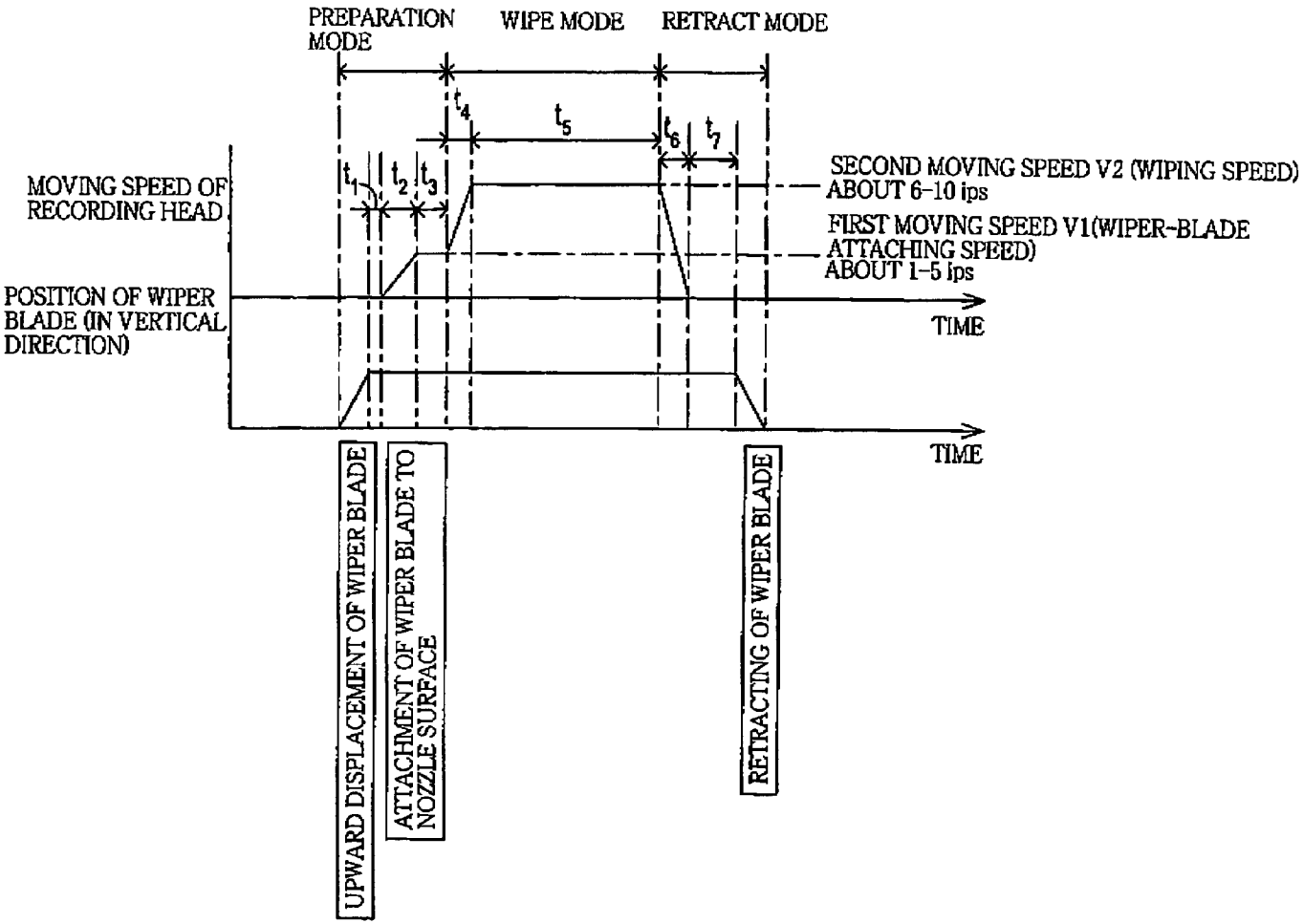
FIG. 4 is a time chart for explaining operation of the cleaning mechanism according of the first embodiment.

In the illustrated first embodiment shown in FIGS. 3-5, the linear solenoid 15*e* is employed as the position changer which changes the position of the wiper blade 15*a* between the first position and the second position. The position changer may be otherwise embodied. For instance, there may be employed, as the position changer, an actuator including a rack pivotably connected to the wiper blade 15*a*, a pinion gear meshing the rack, a servomotor for rotatably driving the pinion gear, and so on.

In the illustrated embodiments, the nozzle surfaces 10*f* faces downwards in the vertical direction. The nozzle surface 10*f* may be arranged such that a direction perpendicular to the nozzle surface 10*f* coincides with a horizontal direction [is parallel to the horizontal plane].

In the illustrated first embodiment shown in FIGS. 3-5, the wiper blade 15*a* which has wiped the nozzle surface 10*f* is arranged to separate therefrom only by its own weight. There may be applied, to the wiper blade 15*a*, a force that enables the wiper blade 15*a* to separate from the nozzle surface 10*f*, by elastic means such as a spring.

While, in the illustrated embodiments, the portion of the recording head 10 that provides the nozzle surface 10*f* is formed of the ferrous metal such as the FE42 alloy, that portion may be formed of a ferromagnetic material such as nickel or cobalt.

While, in the illustrated embodiments, the principle of the invention is applied to the multi-function apparatus having a function as the ink-jet type printer, the principle of the invention is applicable to an ink-jet type printer itself.

It is to be understood that the invention is not limited to the details of the illustrated embodiments, but may be embodied with various changes and modifications, which may occur to those skilled in the art, without departing from the spirit and scope of the invention defined in the attached claims.

What is claimed is:

1. An ink-jet recording apparatus comprising:

a recording head which has a nozzle surface in which nozzles are open and which ejects ink toward a recording medium; and a wiper blade which wipes the nozzle surface to remove substances adhering thereto, by a relative movement of the wiper blade and the recording head, wherein the ink-jet recording apparatus is arranged such that the wiper blade wipes the nozzle surface while being in contact with the nozzle surface by a magnetic attraction force which acts between the wiper blade and the nozzle surface and which is generated by magnetization of one of the wiper blade and the nozzle surface.

2. The ink-jet recording apparatus according to claim 1, wherein a portion of the recording head that constitutes the nozzle surface is made of a magnetic material and the wiper blade is constituted by including a flexible magnet in which are diffused powders having a magnetic property.

3. The ink-jet recording apparatus according to claim 2, wherein a matrix of the flexible magnet is rubber.

4. The ink-jet recording apparatus according to claim 2, wherein at least a portion of the wiper blade which contacts the nozzle surface is constituted by the flexible magnet.

5. The ink-jet recording apparatus according to claim 4, wherein an entirety of the wiper blade is constituted by the flexible magnet.

6. The ink-jet recording apparatus according to claim 1, further comprising a position changer which changes a position of the wiper blade between:

a first position which enables the wiper blade to be attached to the nozzle surface by the magnetic attraction force; and a second position which is more distant from the nozzle surface than the first position.

7. The ink-jet recording apparatus according to claim 6, wherein, the second position is a position which disables the wiper blade to be attached to the nozzle surface by the magnetic attraction force.

8. The ink-jet recording apparatus according to claim 7, wherein the wiper blade is disposed in a region where the recording head is allowed to eject the ink toward the recording medium, and wherein the ink-jet printer is arranged such that, in a state in which the wiper blade is in the second position, the recording head ejects the ink toward the recording medium interposed between the wiper blade and the nozzle surface.

9. The ink-jet recording apparatus according to claim 6, wherein the position changer includes a solenoid by which the position of the wiping blade is changed between the first position and the second position.

10. The ink-jet recording apparatus according to claim 1, wherein the wiper blade and the recording head move relative to each other in at least:

(a) a preparation mode in which the wiper blade spaced apart from the nozzle surface is brought into contact with the nozzle surface; and (b) a wipe mode in which the wiper blade and the nozzle surface move relative to each other with the wiper blade being in contact with the nozzle surface, and wherein the wiper blade and the recording head move relative to each other in the preparation mode at a speed lower than that in the wipe mode.

11. The ink-jet recording apparatus according to claim 1, wherein the nozzle surface faces downwards in a vertical direction, and wherein the wiper blade is located below the nozzle surface in the vertical direction and is arranged to be pivotable about one end thereof.

12. The ink-jet recording apparatus according to claim 11, wherein the wiper blade pivots about said one end thereof, whereby another end thereof moves upwards so that the wiper blade is attached at said another end to the nozzle surface.

13. The ink-jet recording apparatus according to claim 12, wherein the wiper blade is inclined, in a state in which the wiper blade is not attached to the nozzle surface, such that said one end thereof is located below said another end thereof.

14. The ink-jet recording apparatus according to claim 13, wherein the wiper blade keeps a posture that defines an angle from 20° to 30° with respect to a horizontal plane, in the state in which the wiper blade is not attached to the nozzle surface.

15. The ink-jet recording apparatus according to claim 14, wherein the wiper blade keeps a posture that defines an angle from 45° to 65° with respect to the horizontal plane, in a state in which the wiper blade is attached to the nozzle surface.

16. The ink-jet recording apparatus according to claim 1, wherein the magnetic attraction force is set such that a contact pressure between the wiper blade and the nozzle surface in a state in which the wiper blade is attached to the nozzle surface is not smaller than 0.003 MPa.

17. The ink-jet recording apparatus according to claim 1, wherein the wiper blade has JIS A hardness of 30-60 degrees specified in JIS K 6301.

18. The ink-jet recording apparatus according to claim 1, wherein the wiper blade is configured such that one end portion thereof that is to be in contact with the nozzle surface is tapered.

19. The ink-jet recording apparatus according to claim 1, wherein the wiper blade contacts the nozzle surface while being elastically deformed by the magnetic attraction force, and wherein the wiper blade generates, in a state in which the wiper blade is in contact with the nozzle surface, an elastic restoring force in a direction away from the nozzle surface.

20. An ink-jet recording apparatus comprising:

a recording head which has a nozzle surface in which nozzles are open and which ejects ink toward a recording medium; and a wiper blade which wipes the nozzle surface to remove substances adhering thereto, by a relative movement of the wiper blade and the recording head, wherein the nozzle surface and at least a part of the wiper blade which is to be in contact with the nozzle surface are formed respective materials have a magnetic property, and wherein the ink-jet recording apparatus is arranged such that the wiper blade wipes the nozzle surface while being in contract with the nozzle surface by a magnetic attraction force acting between the nozzle surface and the at least a part of the wiper blade which is to be in contact with the nozzle surface.

* * * * *